United States Patent [19]

Ogawa et al.

[11] Patent Number: 4,837,564

[45] Date of Patent: Jun. 6, 1989

[54] DISPLAY CONTROL APPARATUS EMPLOYING BIT MAP METHOD

[75] Inventors: Shinji Ogawa, Sagamihara; Haruhiko Tsuchiya, Yokohama; Tsutomu Araki, Sagamihara; Hiroshi Aoki, Yokohama; Hiroshi Yamamoto, Sagamihara, all of Japan

[73] Assignee: Panafacom Limited, Yamato, Japan

[21] Appl. No.: 928,005

[22] Filed: Nov. 7, 1986

Related U.S. Application Data

[63] Continuation-in-part of Ser. No. 917,087, Sep. 17, 1986.

[30] Foreign Application Priority Data

May 7, 1985 [JP] Japan ..... 60-96436

[51] Int. Cl.[4] ..... G09G 3/16

[52] U.S. Cl. ..... 340/750; 340/748; 340/799

[58] Field of Search ..... 340/750, 747, 735, 723, 340/798, 799, 731, 748; 364/518, 521

[56] References Cited

U.S. PATENT DOCUMENTS

| | | | |
|---|---|---|---|
| 4,418,344 | 11/1983 | Brown | 340/750 |
| 4,504,828 | 3/1985 | Cooper et al. | 340/750 |
| 4,646,077 | 2/1987 | Culley | 340/750 |
| 4,646,261 | 2/1987 | Ng | 340/750 |
| 4,680,578 | 7/1987 | Hornig et al. | 340/735 |

*Primary Examiner*—Donald J. Yusko
*Assistant Examiner*—Alvin Oberley
*Attorney, Agent, or Firm*—Staas & Halsey

[57] ABSTRACT

A display control apparatus using a bit map method, for controlling character attribute data, such as an underline and an overline. In the apparatus, a line control memory is arranged to preset information of character attributes in units of lines of character fonts to be transferred to a video memory; in a DMA transfer sequence of a DMA transfer controller. Character attribute control is performed in a character controller for each line transfer according to the attribute information read out from the line control memory, and expansion of a character font from a character font memory area to the video memory can be simultaneously performed with processing of character attributes from the line control memory.

7 Claims, 11 Drawing Sheets

14

| ATCL \ MODE | OVERLINE | | | UNDERLINE | | |
|---|---|---|---|---|---|---|
| | R | G | B | R | G | B |
| 1 | 1 | 0 | 1 | 0 | 0 | 0 |
| 2 | 0 | 0 | 0 | 0 | 0 | 0 |
| 3 | 0 | 0 | 0 | 0 | 0 | 0 |
| 4 | 0 | 0 | 0 | 0 | 0 | 0 |
| 5 | 0 | 0 | 0 | 0 | 0 | 0 |
| 6 | 0 | 0 | 0 | 0 | 0 | 0 |
| 7 | 0 | 0 | 0 | 0 | 0 | 0 |
| 8 | 0 | 0 | 0 | 1 | 0 | 1 |

DISPLAY CONTROL APPARATUS EMPLOYING BIT MAP METHOD

CROSS REFERENCE TO RELATED APPLICATION

This is a continuation in part application of patent application Ser. No. 917,087 filed on Sept. 17, 1986 under International Application No. PCT/JP86/00227 filed on May 2, 1986.

This application is related to U.S. application Ser. No. 928,012, filed on Nov. 7, 1986 and Ser. No. 939,771, filed on Oct. 27, 1986, both by Ogawa et al.

BACKGROUND OF THE INVENTION

1. Field of the Invention

The present invention relates to a display control apparatus employing a bit map system. More particularly, it relates to a system including a display character attribute control apparatus wherein transfer data representing character attributes such as an underline and an overline can be processed in a direct memory access (DMA) transfer sequence for transferring character fonts from a main memory or a pattern read-only memory (ROM) to a video random access memory (VRAM), and a character font transfer control apparatus which allows an automatic performance of a so-called multi font control, a vertical expansion (enlargement) control of characters, an extension control of vertical ruled lines, and the like, in the DMA transfer sequence for transferring character font data from the main memory or pattern ROM to the VRAM.

2. Description of the Related Art

A bit map system is extensively known as a means for displaying characters and graphic patterns on a CRT display. In this system, a video memory (VRAM) corresponding to a display screen is arranged, and information on the display screen is temporarily stored in the VRAM and then read out as a video signal to be displayed. Compared with a system wherein a video signal is directly derived from a character code by a character generator, a pattern expansion of 72 bytes is required in the bit map system if one character is displayed in a $24\times24$ dot pattern. The expansion of the character screen in the VRAM requires a long period of time, thus reducing the processing speed. In order to increase the processing speed in a conventional system, a character font is transferred from a main memory or a pattern ROM to a VRAM according to a DMA transfer scheme.

In a conventional system, in order to process character attributes (e.g., an underline, an overline, and a cursor) for a character to be displayed, a special graphic controller is prepared to perform line drawing processing, thereby realizing attribute processing.

However, in the conventional systems described above, character font DMA transfer control is performed independently of processing control of character attributes such as an underline and an overline. The control sequences are complicated, and the number of hardware components for realizing such control sequences is large. As a result, the circuit is complicated. At the same time, the processing speed for expanding the display data in the VRAM is reduced. Therefore, a total processing speed is not satisfactorily increased.

Similarly, to improve the processing speed, character font data is transferred from a main memory or a pattern ROM to the VRAM by a DMA transfer method. The transferred character font data is allocated a predetermined position on the VRAM as screen data, or character expansion control or ruled line connection control is executed by a dedicated controller.

With the conventional method, however, since the DMA transfer control is also performed independently from the character expansion control or ruled line connection control, the volume of hardware therefor increases, and it takes a great deal of time to expand a pattern in the VRAM.

SUMMARY OF THE INVENTION

It is an object of the present invention to provide a display character attribute control apparatus with an improved display character attribute processing speed.

It is another object of the present invention to provide a display character attribute control apparatus wherein patterns for various attributes can be effectively displayed.

It is still another object of the present invention to provide a character font transfer control apparatus which performs character vertical expansion control or ruled line connection control during a DMA transfer sequence to reduce the volume of hardware and improve a processing speed.

It is yet another object of the present invention to provide a display control apparatus employing a bit map method and performing the above character attribute display control and character font transfer display control.

It is still another object of the present invention to provide a display control method employing a bit map method and effecting the above display control.

According to the present invention, there is provided a display control apparatus employing a bit map method, including: a video data memory, operatively connected to a display device, for storing display data to be displayed on the display device; a first memory for storing and outputting character fonts corresponding to characters to be displayed on the display device; a second memory for storing at least character attribute data in units of transfer lines of the character fonts and outputting the same; a direct memory access (DMA) transfer control circuit, operatively connected between the character attribute storing memory and the video data memory, for controlling a read operation of the character attribute storing memory; a character attribute control circuit, operatively connected to the character attribute storing memory, the character font storing memory and the DMA transfer control circuit, for processing and controlling transfer data of the character fonts in response to the character attribute data read out from the character attribute storing memory; and a processing unit, operatively connected to the character font storing memory, the character attribute storing memory, the DMA transfer control circuit and the character attribute controlling circuit, for controlling operations in the connected circuits. The DMA transfer control circuit controls the character attribute controlling circuit so that the transfer data of the character fonts which are processed in response to the character attribute data are stored in the video data memory in a DMA transfer sequence.

The character attribute data may comprise at least underlines and/or overlines which are combined with the transfer data.

The character attribute data may also comprise color data.

The character attribute data storing memory may store expansion data. The character attribute control circuit may further expand the transfer data and the character attribute data in response to the expansion data. The attributed and expanded data are stored in the video data memory in the DMA transfer sequence.

BRIEF DESCRIPTION OF THE DRAWINGS

Other objects and features of the present invention will be clearly understood with reference to the accompanying drawings, in which.

DETAILED DESCRIPTION OF THE PREFERRED EMBODIMENTS

The basic block configuration and the basic operation of the present invention will be described with reference to FIG. 1 prior to a description of a preferred embodiment thereof.

Figure 1:
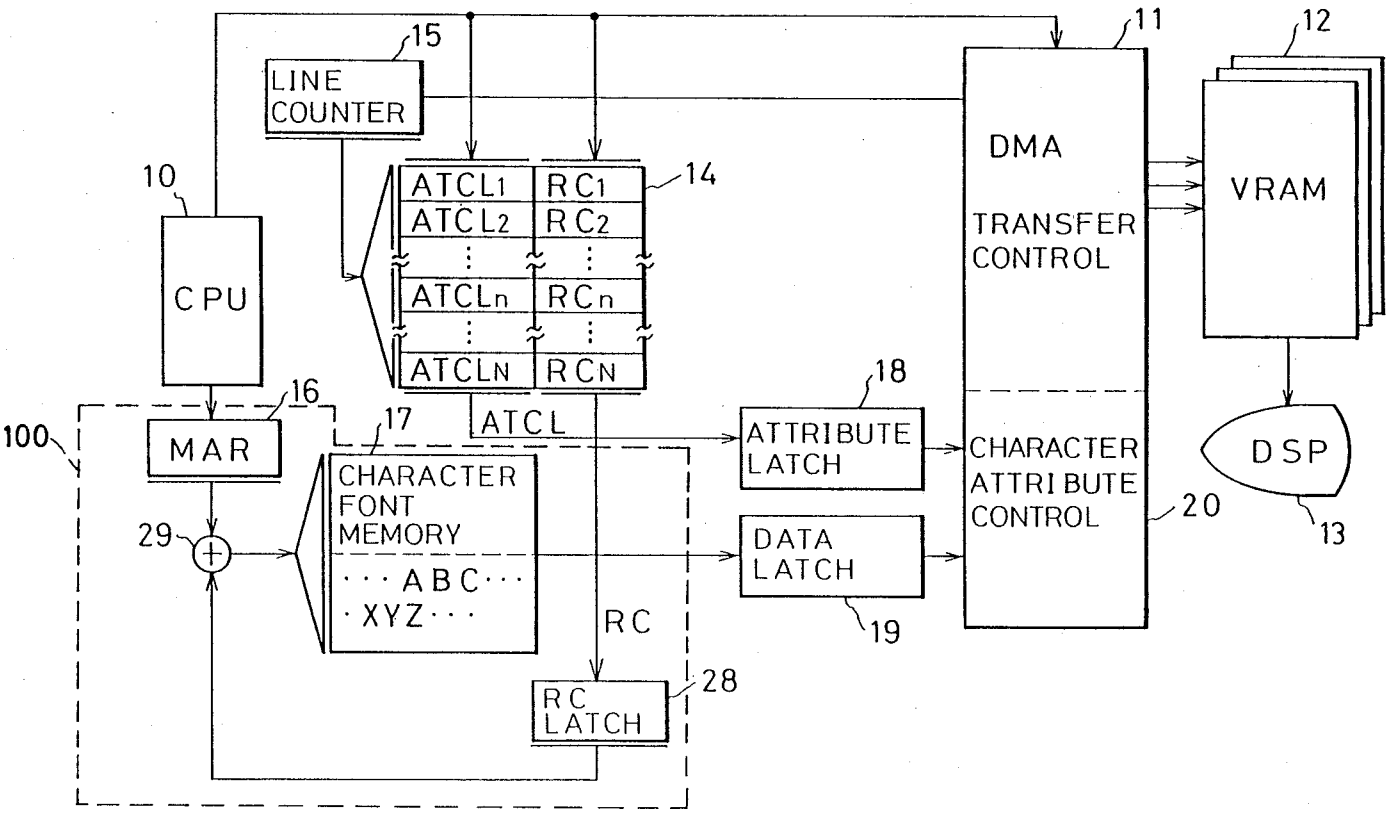
FIG. 1 is a basic block diagram of a display control apparatus of the present invention.

Referring to FIG. 1, a central processing unit (CPU) 10 comprises a processor for sequentially fetching and executing instructions and for causing a display device 13 to display processed results or the like. A DMA transfer controller 11 DMA-transfers a character font designated by the CPU 10 to a VRAM 12 and controls expansion of transfer data in a predetermined pattern. The display device 13 converts image information in the VRAM 12 to a video signal and displays the video signal. A line control memory 14 is a memory arranged, for example, in a predetermined area at a main memory. The line control memory 14 registers character attribute information for processing character font transfer data in units of transfer lines of the character fonts. The line control memory 14 also stores raster count (RC) data indicating which line portion of a character font is to be transferred for each transfer line of the character font. A line counter 15 is a counter controlled by the DMA transfer controller 11 to supply a read address to the line control memory 14. A memory address register (MAR) 16 is a register for storing a storage address of a character font to be displayed. The memory address register 16 is accessed by the CPU 10. A character font storage area 17 is an area for storing a character font corresponding to each character in a main memory, a kanji (Japanese letters) ROM, or the like. An attribute latch 18 is a circuit for latching character attribute information read out from the line control memory 14. A data latch 19 is a circuit for latching data read out from the character font memory area 17. A character attribute controller 20 is a circuit for determining if the data latched by the data latch 19 is to be transferred or data is to be transferred after attribute processing according to the attribute information latched by the attribute latch 18 and for controlling character attribute control in a DMA transfer sequence.

In addition, a raster count (RC) latch circuit 28 and an adder 29 are provided. The RC latch circuit 28, the adder 29 and the MAR 16 form an address modification section 100. The address modification section 100 is a circuit for generating a line address as a transfer object in a character font storage memory 17 by adding a stored character font start address sent in the MAR 16 and RC data read out to the RC latch circuit 21.

Figure 2:
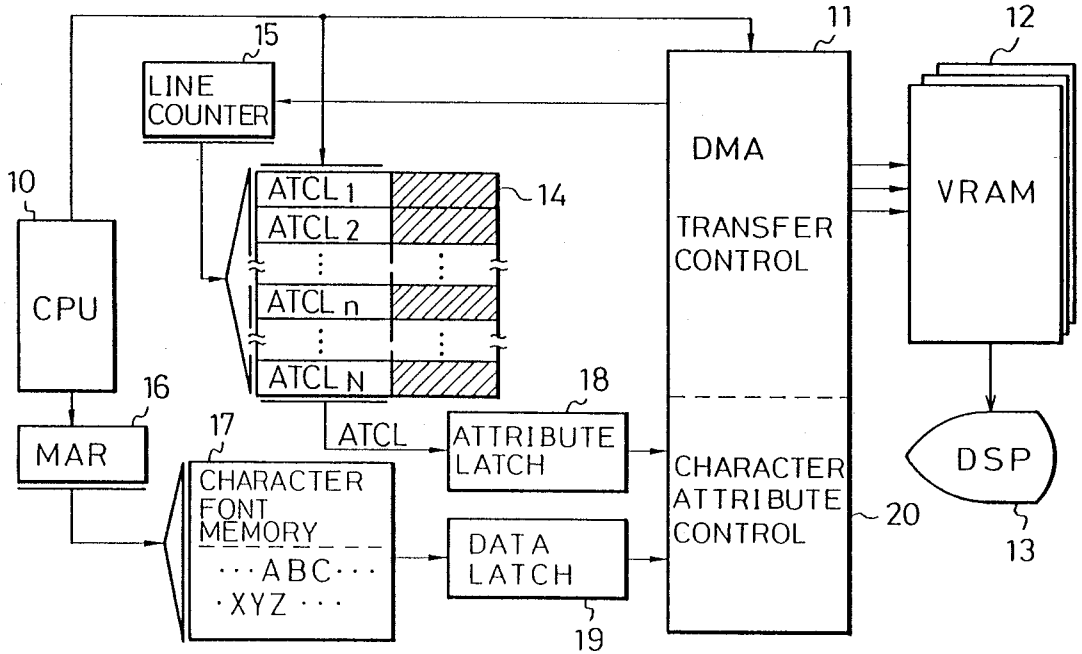
FIG. 2 is a block diagram of a display control apparatus of an embodiment according to the present invention, which performs a character attribute control.

First, the basic operation of the display character attribute control apparatus having the above arrangement according to the present invention will be described below, with reference to FIG. 2. FIG. 2 is a block diagram of a display control apparatus having an arrangement adapted to perform the display character attribute control. In FIG. 2, the RC latch circuit 28 and the adder 29 are omitted from the apparatus shown in FIG. 1.

The CPU 10 presets attribute information such as an underline, an overline, and the like in the line control memory 14, and sets a start address of the character font to be displayed in the memory address register 16. When the CPU 10 causes the DMA transfer controller 11 to start, the count of the counter 15 is updated by the DMA transfer controller 11 and attribute information is read out from the line control memory 14. The character attribute processing is performed by the character attribute controller 20. The attribute information can be used to specify, e.g., colors of an underline, an overline, and the like. The attribute information is arbitrarily set in the line control memory 14. Data processing by desired character attributes can be realized in the DMA transfer sequence for the VRAM 12.

The display character attribute controller performs processing of character attributes such as an underline and an overline in the DMA transfer sequence.

Figure 3:
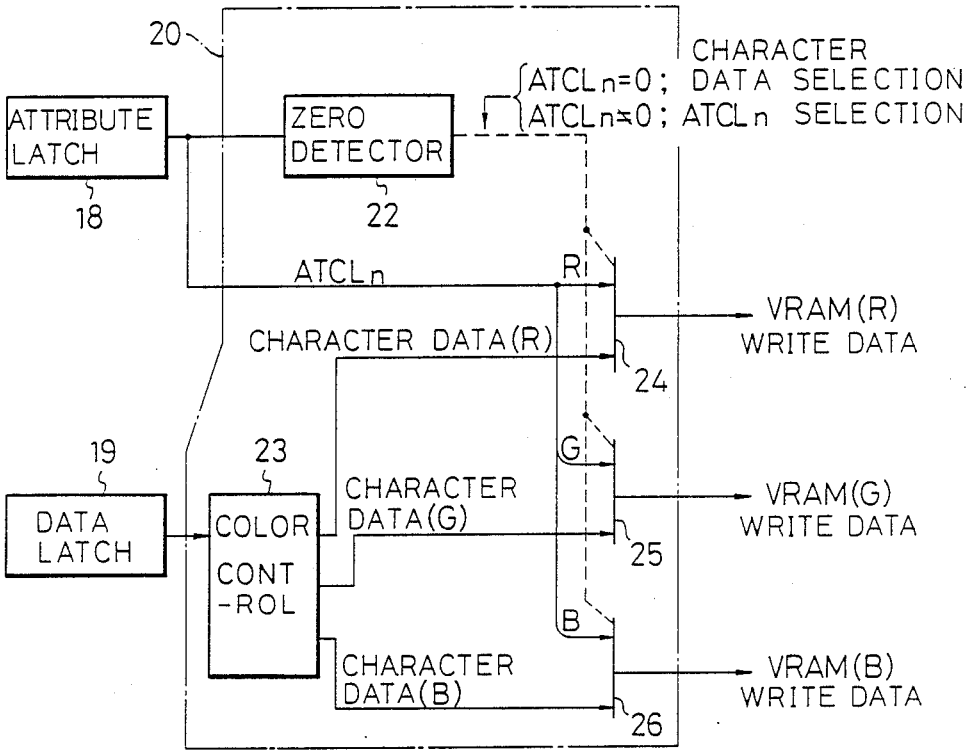
FIG. 3 is a view showing a character attribute control circuit as the embodiment of the present invention.
Figures 4, 5:
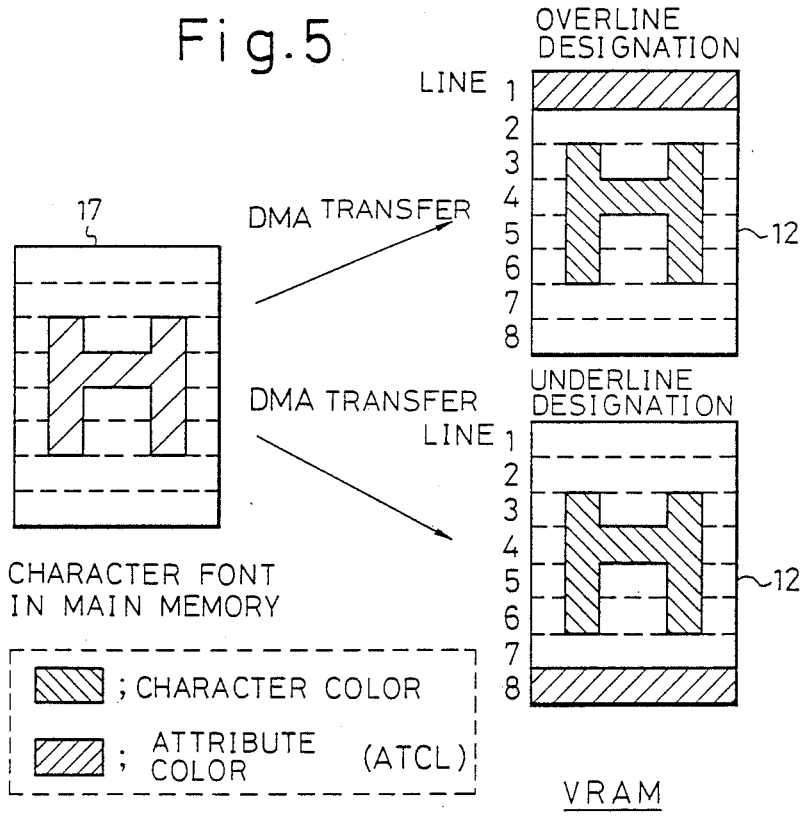
FIG. 4 is a table for explaining data set in a line control memory as an embodiment of the present invention.
FIG. 5 is a view for explaining a character attribute control mode as an embodiment of the present invention.
Figure 6:
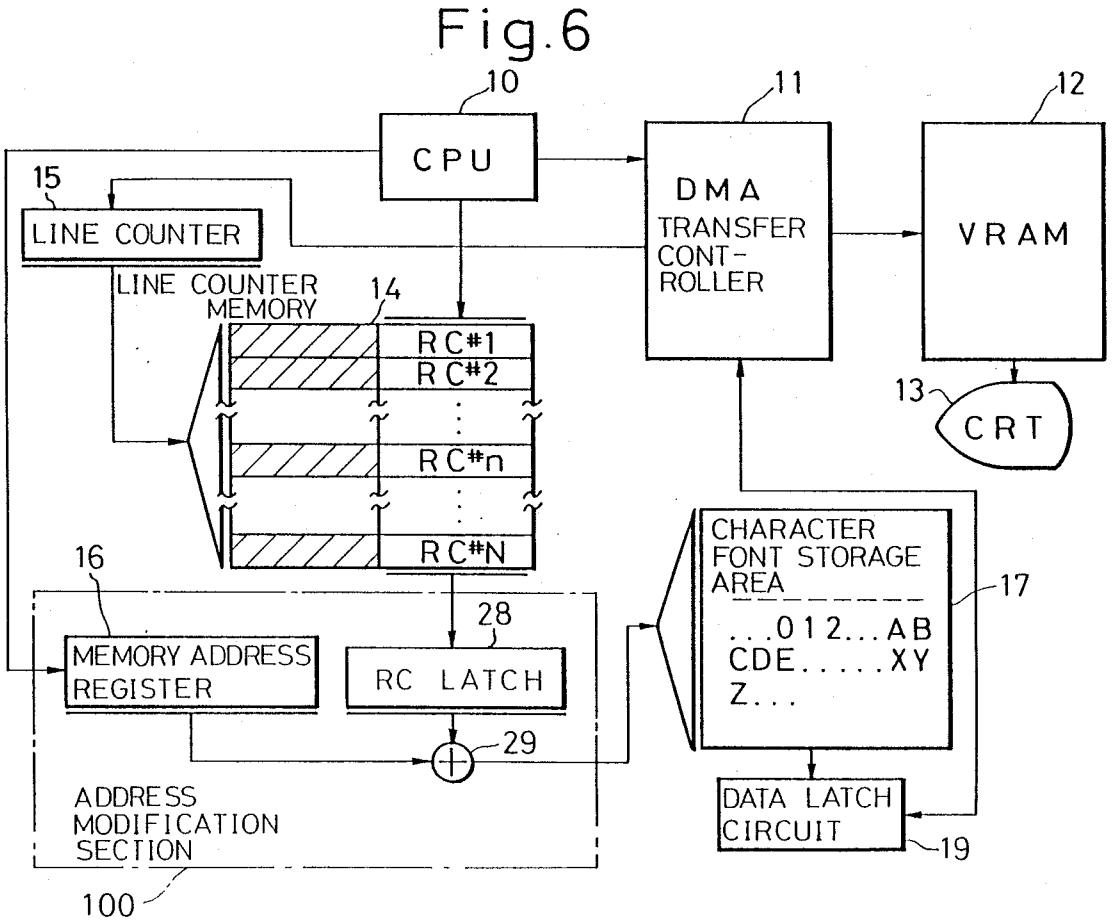
FIG. 6 is a block diagram showing a schematic arrangement of a character font transfer control method of another embodiment according to the present invention.
Figure 10:
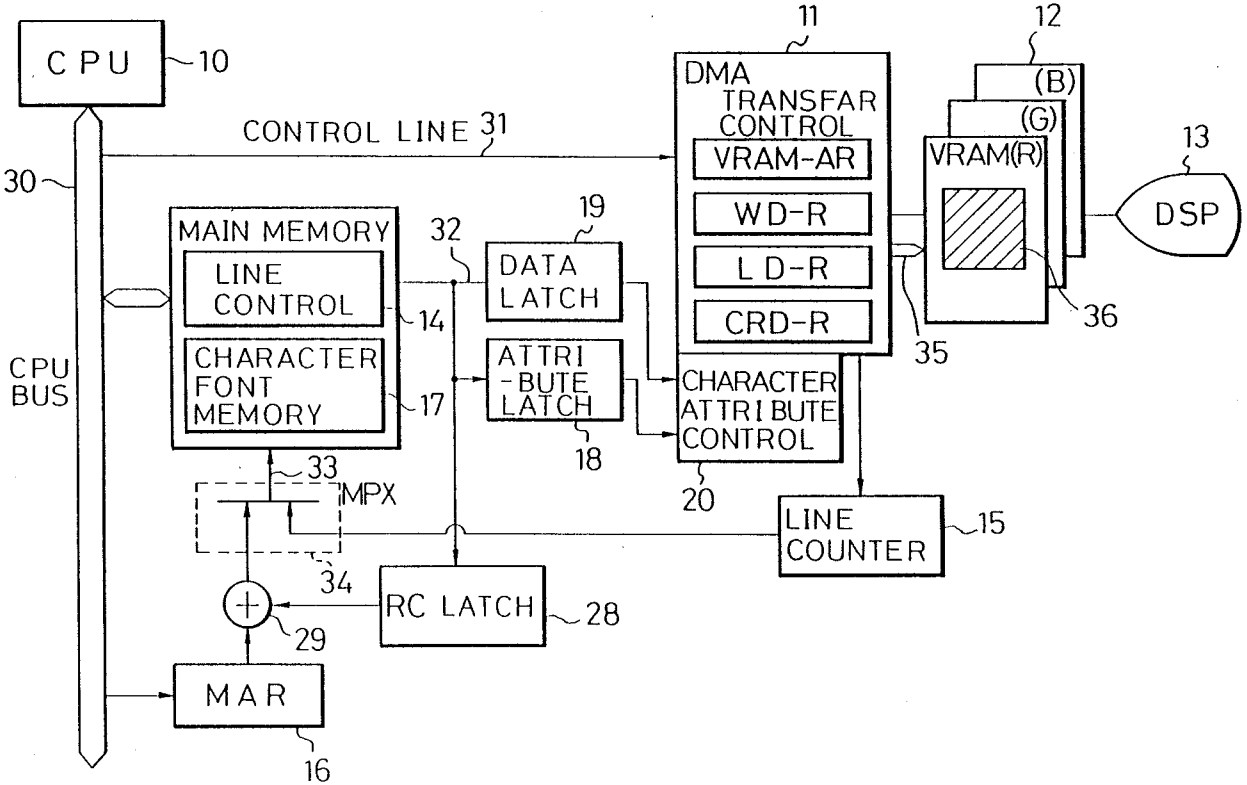
FIG. 10 is a block diagram of an apparatus as an embodiment of the present invention.

The preferred embodiment of the present invention will be described in detail with reference to the accompanying drawings. The accompanying drawings show detailed arrangements of the constituting elements in FIG. 2. FIG. 3 shows an arrangement of the character attribute controller, FIG. 4 is a view for explaining data set in the line control memory, FIG. 5 is a view for explaining the character attribute control mode; FIG. 6 is a block diagram of an apparatus as one embodiment of the present invention, FIG. 10 is a view for explaining character attribute control accompanying vertical elongation control, and FIGS. 12*a* to 12*i* is a timing chart for explaining the character font DMA transfer sequence according to the embodiment of the present invention.

The character attribute controller 20 in FIG. 2 is arranged in detail, as shown in FIG. 3. Referring to FIG. 3, reference numeral 22 denotes a zero detector for checking whether character attribute information ATCLn latched by the attribute latch 18 is all-zero data; 23, a character color control circuit for controlling a display character color; and 24 to 26, multiplexers, respectively.

In this embodiment, the character and the attribute such as an underline can be displayed in a maximum of eight colors. The character attribute information ATCLn comprises 3 bits and represents a color of an attribute such as an underline in correspondence with color factors R, G, and B. A character font read out from the character font memory area 17 is converted to color factor R, G and B data by the character color controller 23. The zero detector 22 determines whether the three bits of the attribute information ATCLn are all zeros in units of transfer lines. If the three bits are determined to be all zeros, character data (R), (G), and (B) are respectively selected by the multiplexers 24 to 26 and are transferred to the VRAM 12. If the three bits are determined not to be all zeros, the transfer line is set as "1" in the VRAM 12 regardless of the character data according to the color factors specified by the ATCLn.

According to the above control, an overline, an underline, and the like can be designated, as will be described below. In this embodiment, for example, a standard character font is constituted by 8-line dots. If a magenta overline (OL) is specified, data is set in the line control memory 14, as shown in FIG. 4. In this case, the attribute information ATCL1 for the first line is given as "101" so that "1"s are respectively written in the R and B planes in the VRAM 12. Therefore, an overline is drawn, as shown in FIG. 5. In the second line and the subsequent lines, ATCL2 to ATCL8 are all zeros so that the character fonts in the main memory can be written in designated colors in the VRAM 12.

Similarly, in order to designate an underline, "101" is written at the ATCL8 position, as shown in FIG. 4. "1" is written in the designated attribute color on only the eighth line of underline designation, as shown in FIG. 5.

Although omitted from the accompanying drawings, attribute information can be designated for a plurality of lines, and then the lines can be used as a line cursor. It is also possible to highlight a portion with a predetermined color. Since an attribute color can be specified as the character attribute information ATCLn, the colors of an overline, an underline, and the like can be designated independently of the colors of character fonts.

In the above embodiment, each ATCL comprises 3 bits, but it may comprise four or more bits to achieve a multicolor display.

Second, the basic operation of the automatic character font transfer control according to the present invention will be described in detail with reference to FIG. 6. FIG. 6 is a block diagram of a display control apparatus having an arrangement adapted to perform the character font transfer control. In FIG. 6, the attribute latch 18 and the character attribute controller 20 shown in FIG. 1 are omitted.

The CPU 10 causes the RC data to be preset in the line control memory 14 and causes the start address of a character font to be displayed to be stored in the MAR 16 CPU 10 then enables the DMA transfer controller 11 updated, the line counter 15 by the DMA transfer controller 11, and the address of the character font storage area 17 is generated by the address modification section 100. Then, character font data corresponding to the generated address is DMA-transferred to the VRAM 12 through the data latch circuit 19.

Figure 7:
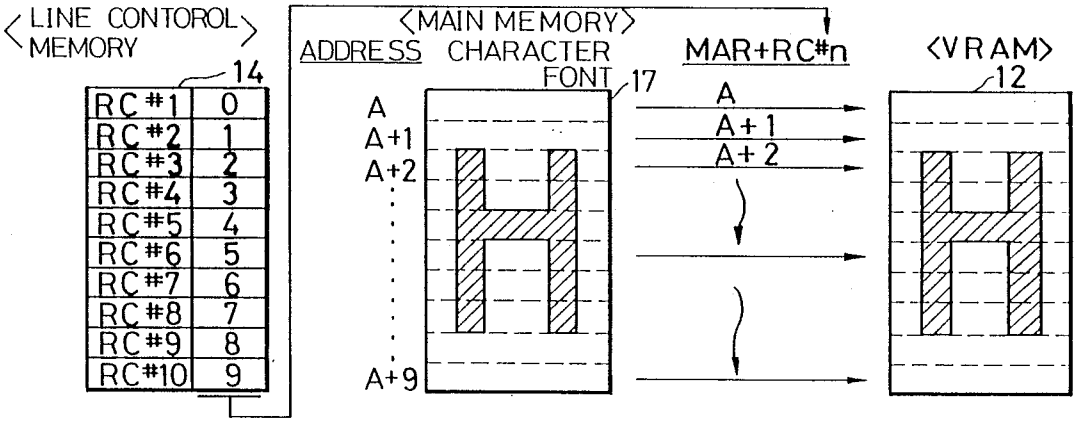
FIG. 7 is a block diagram for explaining character font DMA transfer control according to the present invention.
Figure 8:
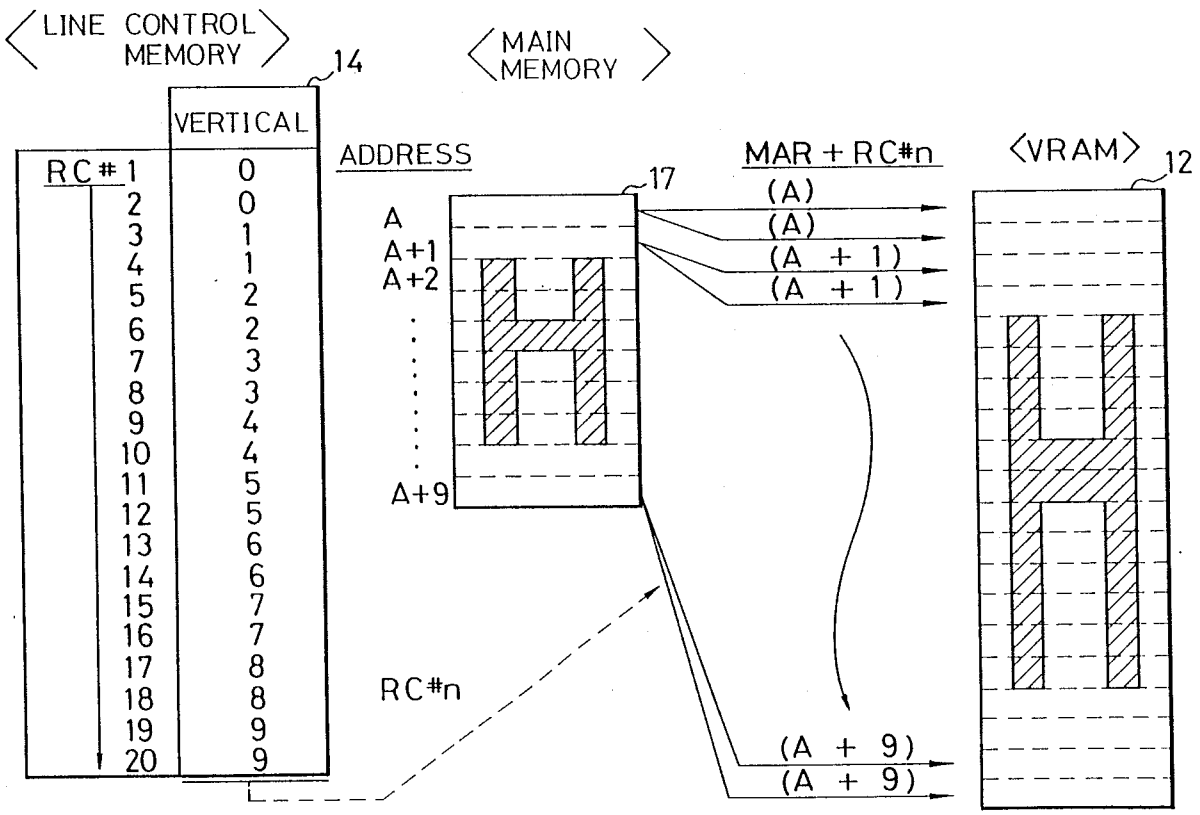
FIG. 8 is a view for explaining vertical expansion DMA transfer control.
Figure 9:
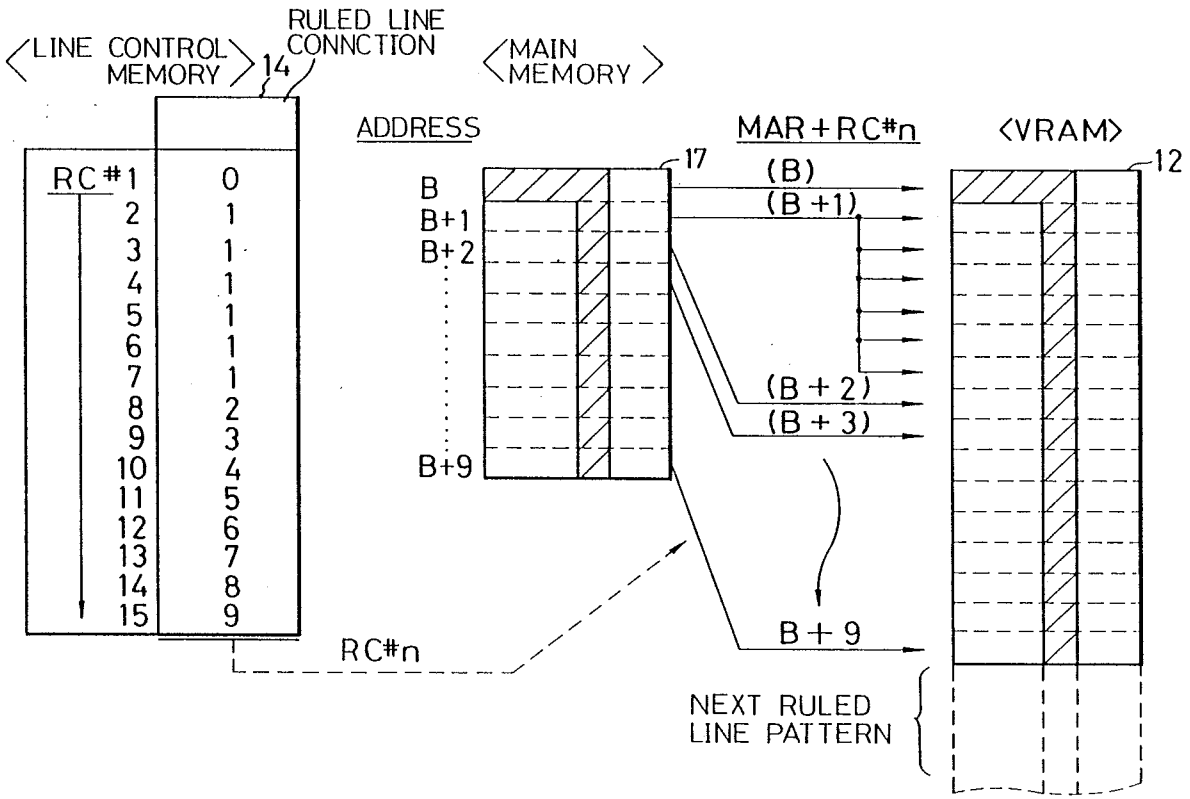
FIG. 9 is a view for explaining ruled line connection control.

The operation of the apparatus shown in FIG. 6 will be described with reference to FIGS. 7 to 10. FIG. 7 is a representation for explaining the character font DMA transfer control of the embodiment according to the present invention; FIG. 8 is a representation for explaining the vertical expansion DMA transfer control; and FIG. 9 is a representation for explaining the ruled line connection control.

For this explanation, it is assumed that a standard character font comprises 10 lines of dots. In character font transfer in a normal mode, as shown in FIG. 7, the CPU 10 shown in FIG. 6 presets values "0" to "9" as RC data RC#1 to RC#10 in the line control memory 14. Assuming that the start address of the character font in the main storage 17 to be displayed is "A", character font transfer to and expansion on the VRAM 12 are performed as follows.

A first line to be DMA-transferred is a line at an address "A +0" obtained by adding the value "0" of the RC data RC#1 to the start address "A". A next line to be DMA-transferred is a line at an address "A +1" obtained by adding the value "1" of the RC data RC#2 to the start address "A". Similarly, the lines of the character font are read out with reference to the address positions obtained by adding the content of the MAR 16 and the values of the RC data in the line control memory 14, and are expanded on the VRAM 12. Note that data, such as destination addresses and the number of transfer lines, is acknowledged to the DMA transfer controller 11 in advance by the CPU 10.

When the CPU 10 displays a vertically expanded character, the RC data is set in the line control memory 14 in the state shown in FIG. 8. More specifically, in a vertical double expansion mode, each index value is set twice for each of the RC data RC#1 to RC#20, i.e., "0,0", "1,1", . . . , "9,9". Thereby, lines of the character font at the addresses "A", "A+1", . . . , "A+9" are transferred to the VRAM 12 twice, and a vertically expanded character is automatically generated in the VRAM 12.

When a ruled line (used in, for example, a table) is to be displayed, control for extending a ruled line is required so as not to cause disconnection of the ruled line between character lines. Ruled line connection can be easily realized as follows.

As shown in FIG. 9, RC data having a plurality of identical index values between lines corresponding to a distance therebetween is preset in the line control memory 14. In the example of FIG. 9, all the RC data RC#2 to RC#7 are set to be "1". If a ruled line pattern to be displayed is preset after the address "B" in the main storage 17, a line at an address "B+1" is transferred six times, thereby automatically generating and connecting the ruled line in the VRAM 12.

As described above, when the index values of character font lines to be transferred are appropriately set in the line control memory 14, various desired pattern expansion can be realized in the DMA transfer sequence.

Still another embodiment of the present invention will be described in detail with reference to FIGS. 10, 11 and 12*a* to 12*i*. This embodiment comprises a combination of the character expansion control, the attribute control, and the ruled line extension control.

FIG. 10 shows an arrangement of an apparatus according to the embodiment of the present invention. Referring to FIG. 10, the same reference numerals used in FIGS. 1, 2 and 6 denote the same parts in FIG. 10. Reference numeral 28 denotes the raster count (RC) latch; 29, the adder; 30, as shown in FIG. 1, a CPU bus; 31, a control line; 32, a data line; 33, an address line; 34, an address multiplexer; 35, a VRAM address control line; and 36, a display screen data.

The VRAM 12 has red (R), green (G), and blue (B) memory areas (planes) for color display. The DMA transfer controller 11 includes a VRAM address register (VRAM-AR) representing an address of the destination VRAM 12, a register (ND-R) for designating a line width of a character font, a register (LD-R) for designating the number of transfer lines, a register (CRD-R) for designating a color and a raster operation (ROP) and the like.

The line width can be designated by a multiple of e.g., four bits. The number of lines corresponds to the line of transfer lines set in the line control memory 14. The CPU 10 arbitrarily designates a character font size according to the line width and the number of lines. Color designation is performed by three character color bits, i.e., R, G, and B bits. ROP designation represents the type of logic operation when the character font is written in the VRAM 12. For example, the types of designation are "store" for writing data, "not store" for reversing source data and writing the reversed data, "superimpose" for writing data of logic "1" in a data portion and leaving a background corresponding to data of logic "0", and the like. The CPU 10 presets control information such as the VRAM addresses and color designation data in the control registers through the CPU bus 30 and the control line 31.

In the embodiment, in addition to character attribute control, character vertical elongation control and ruled line extension control for connecting vertical rules can be performed. Vertical elongation control and ruled line connection control can be designated by setting the attributed information ATCLn and raster counter (RC) information corresponding to the transfer line in the line control memory 14. RC information is data for modifying the character font address in the character font memory area 17 in a main memory or the like in units of lines. RC information is added to the start address of the character font for each line transfer cycle.

Figure 11:
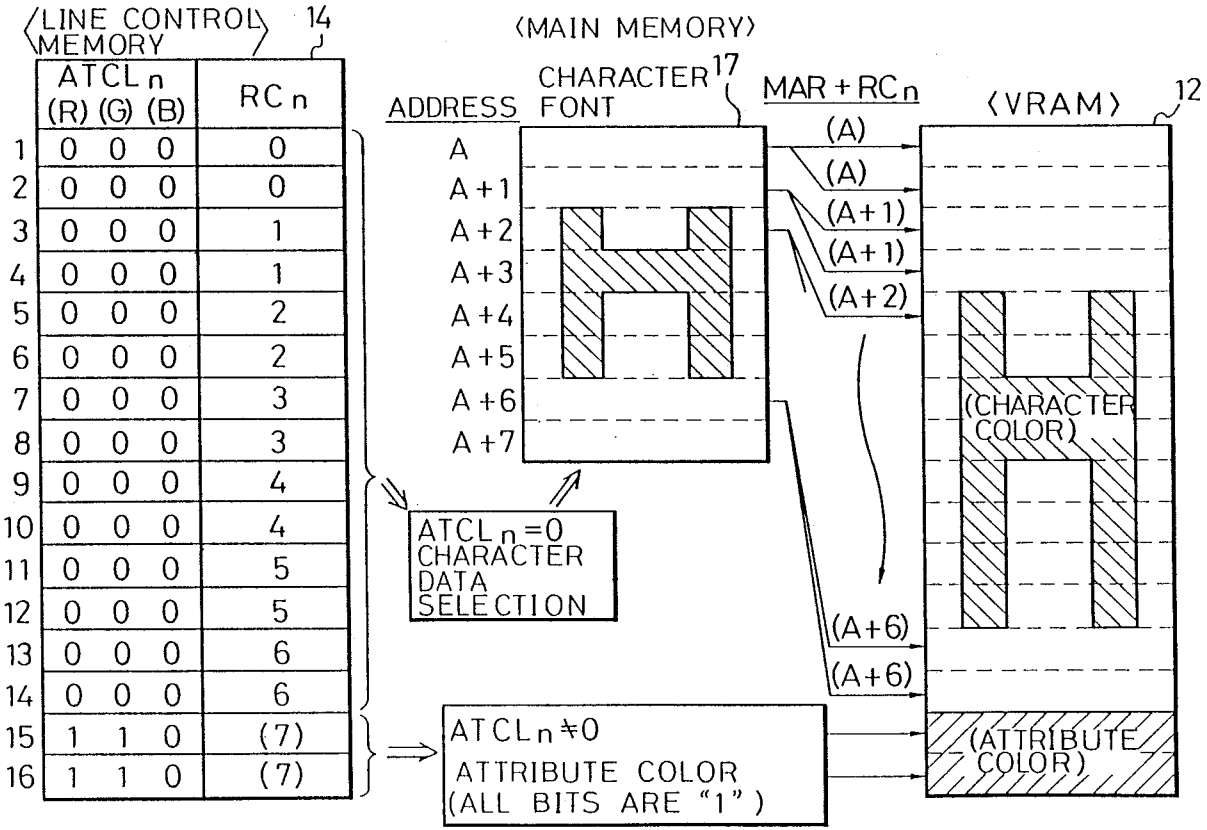
FIG. 11 is a view for explaining character attribute control accompanying vertical elongation control as an embodiment of the present invention.

FIG. 11 shows an example of line cursor character attributed control and a double vertical elongation control as one embodiment of the present invention.

The start address of the character font is address "A" in the character font memory area 17 in the main memory and includes eight lines. 16-line information is set in the line control memory 14 for vertical elongation control. In this embodiment, ATCL15 and ATCL16 are "110"s, respectively. Yellow is designated as the attribute color. The bits of the attribute information for lines 1 to 14 are all zeros. The lines corresponding to this portion indicate that character font data is to be selected. As for RC information, "0"s are respectively set in lines 1 and 2; "1"s are respectively set in lines 3 and 4, "2"s are respectively set in lines 5 and 6, and so on. Thus, the same number is assigned for each two consecutive lines. Since the RC information is used as an index value for determining addresses of lines to be transferred from the character font, each line of the character font is transferred twice, as shown in FIG. 11. Character attribute control and vertical elongation control are simultaneously performed in the DMA transfer sequence.

By setting RC information signals having the same value in the line control memory 14 in the same manner as described above, vertical rule extension and connection control can be achieved. In addition, since the horizontal width and the number of lines are variable, so-called multifont control can also be performed.

The RC latch 28 in FIG. 11 is a circuit for latching RC information read out from the line control memory 14. The adder 29 adds the content of the memory address register 16 and the latched RC information to generate a transfer line address. The address mutiplexer 34 switches between a read operation of the line control memory 14 and a read operation of the character font memory area 17.

Figures 12A, 12B, 12C, 12D, 12E, 12F, 12G, 12H, 12I:
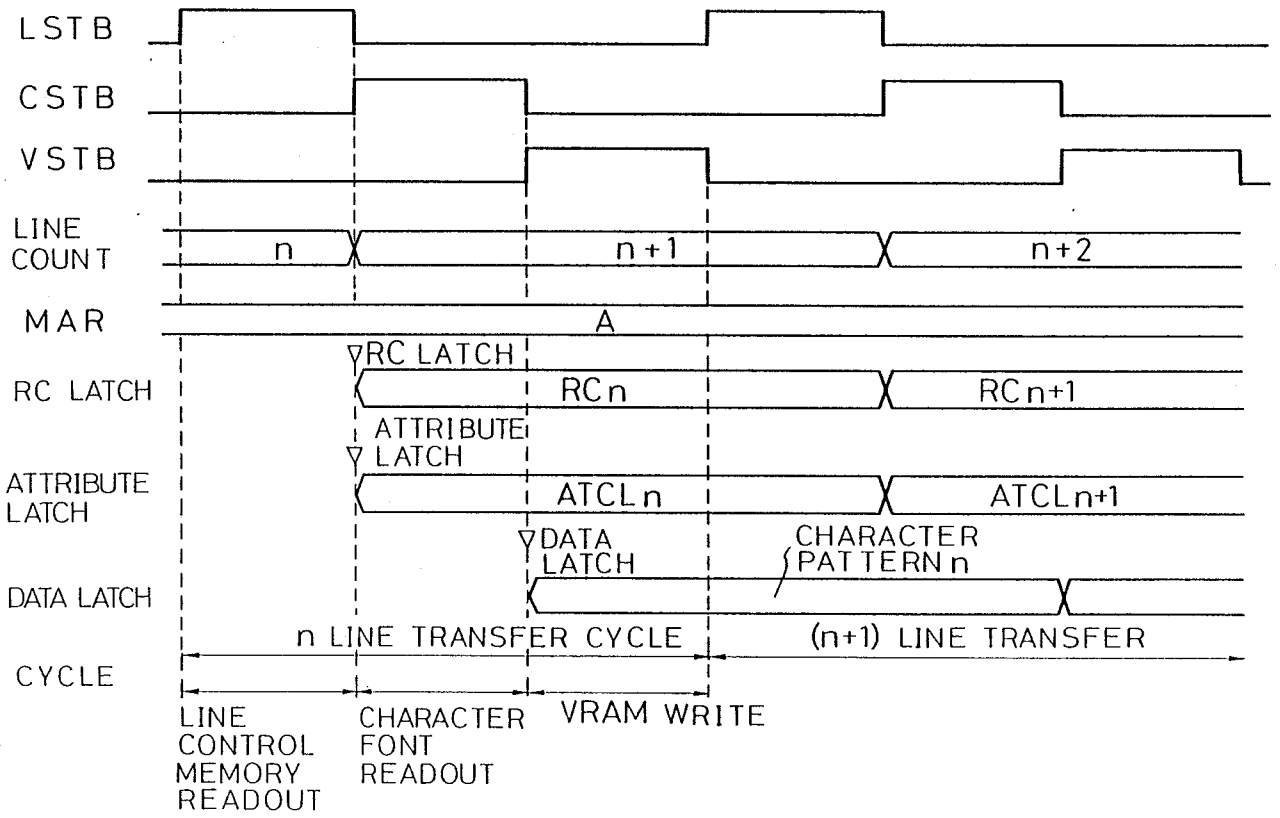
FIGS. 12*a* to 12*i* are timing charts showing a character font DMA transfer sequence according to the embodiment of the present invention.

The DMA transfer sequence in the apparatus of the embodiment shown in FIG. 10 will be described with reference to FIGS. 12*a* to 12*i*.

a. The CPU 10 stores, in the memory address register 16, the start address of the main memory which corresponds to the memory area of the character font to be transferred.

b. The character attribute information ATCLn and the RC information RCn for a required number of lines are set in the line control memory 14.

c. The CPU 10 sets information such as the transfer destination address of the VRAM 12 in the control register in the DMA transfer controller 11 as needed, and causes the DMA transfer controller 11 to start.

d. As shown in FIG. 12*i*, the line control memory read cycle is started. That is, a line strobe signal LSTB is sent out before the character font is read from the main memory. Meanwhile, the attribute information and the RC information are read out from the line control memory 14 in response to the count of the line counter 15. At the trailing edge of the LSTB, the attribute information for the corresponding line is latched by the attribute latch 18 and the RC information is latched by the RC latch 28.

e. A character strobe signal CSTB is then sent out from the DMA transfer controller 11 to initiate the character font read cycle. In this cycle, the value designated by the memory address register 16 is added to the RC information latched by the RC latch 28. A sum is used as a main memory address to read out one-line portion of the character font. The readout data is latched by the data latch 19 at the trailing edge of the CSTB.

f. A VRAM strobe signal VSTB is then output from the DMA transfer controller 11 to initiate the VRAM read cycle. In this cycle the character attribute controller 20 discriminates the attribute information latched by the attribute latch 18. The character pattern latched by the data latch 19 is processed according to the attribute information. The processed data is stored in a predetermined area in the VRAM 12.

g. The DMA transfer cycle comprising the sequences d to f is repeated for each line. When the cycles are repeated for the designated number of lines, the DMA transfer sequence is completed. Attribute processing of the character font in the main memory is performed so that the display data can be expanded in the VRAM 12 in a predetermined pattern.

As described above, the character attribute information in correspondence with the line of the character font to be transferred and the RC information for designating the line to be transferred are properly set in the line control memory 14. By only these operations, desired attribute processing and various pattern expansions can be performed at a high speed in the DMA transfer sequence.

According to the present invention as described above, the attributes such as an underline and an overline can be processed for the character fonts stored in the main memory, the kanji ROM, or the like, and the processed character font can be transferred to the VRAM in the DMA transfer sequence of the character font, thereby improving the efficiency of character attribute processing. For example, attribute color information can be used as the attribute information to display attribute patterns in colors different from those of characters.

Similarly, the number of lines of the character font can be changed by the line control memory 14, and the RC data is programmable. Therefore, 16-dot, 24-dot, and 32-dot character fonts can be transferred. The character fonts can be allocated on the main memory or the kanji ROM, multi font control can be easily realized, and high-speed processing is obtainable.

For example, the present invention is not limited to RC data. Areas for setting other attribute data, e.g., underline, overline, line cursor, and the like, can be provided in the line memory 14, and character font transfer data can be processed by the DMA transfer controller 11 in accordance with the attribute data.

Many widely different embodiments of the present invention may be constructed without departing from the spirit and scope of the present invention. It should be understood that the present invention is not limited to the specific embodiments described in this specification, except as defined in the appended claims.

We claim:

1. A display control apparatus employing a bit map method, comprising:

display means for displaying data;

video data memory means, operatively connected to said display device, for storing display data to be displayed on said display device;

character font storage means for storing and outputting character font data corresponding to characters to be displayed on said display device;

character attribute storage means for storing and outputting character attribute data in units of transfer lines of the character font data;

direct memory access (DMA) transfer control means, operatively connected between said character attribute storage means and said video data memory means, for controlling a read operation of said character attribute storage means, so that the transfer lines of the character font data are transferred to and stored in said video data memory during a DMA transfer sequence;

character attribute control means, operatively connected to said character attribute storage means, said character font storage means and said DMA transfer control means, for processing and controlling the transfer lines of the character font data in response to said character attribute data output from said character attribute storage means; and processing means, operatively connected to said character font storage means, said character attribute storage means, said DMA transfer control means and said character attribute control means, for controlling operations thereof.

2. A display control apparatus according to claim 1, wherein the character attribute data comprise at least underlines and/or overlines and wherein said processing means includes means for processing said character attribute data simultaneously with said transfer data.

3. A display control apparatus according to claim 2, wherein the character attribute data comprise color data.

4. A display control apparatus according to claim 3, wherein said character attribute storage means includes means for storing expansion data; and wherein said character attribute control means includes means for expanding the transfer line data and the character attribute data in response to said expansion data, and for storing the expanded transfer line data and character attribute data in said video data memory means during the DMA transfer sequence.

5. A display control apparatus according to claim 4, wherein said character font storage means includes:

character font memory means for storing said character fonts;

memory address register means, operatively connected between said character font memory means and said processing means for providing addresses for said character fonts stored in said character font memory means in response to a control signal from said processing means; and first latch circuit means, operatively connected between said character font memory means and said character attribute control means, for latching character font data read out from said character font memory means.

6. A display control apparatus according to claim 5, wherein said character attribute storage means further includes:

line control memory means, operatively connected to said processing means, for storing at least said character attribute data;

line counter means, operatively connected between said line control memory means and said DMA transfer control means, for designating said character attribute data to be output; and second latch circuit means, operatively connected between said line control memory means and said DMA transfer control means, for latching data read out from said line control memory means.

7. A display control apparatus according to claim 6, wherein said line control memory means includes means for storing the expansion data; and wherein said display control apparatus further comprises third latch circuit means, operatively connected to said line control memory means, for latching expansion data read out from said line control memory means; and an adder, operatively connected to said memory address register means and said third latch circuit means, for adding the address from said memory address register means and said expansion data from said third latch circuit means and giving same to said character font memory means so as to expand said character fonts.

* * * * *